United States Patent [19]

Kolaczia

[11] 4,253,178

[45] Feb. 24, 1981

[54] DECORATIVE OR ORNAMENTAL APPLIANCE FOR USE WITH ARTICLES SUCH AS WRIST WATCHES

[76] Inventor: Lipot J. Kolaczia, 724 Euclid, Santa Monica, Calif. 90402

[21] Appl. No.: 5,245

[22] Filed: Jan. 22, 1979

[51] Int. Cl.[3] ..... G04B 37/00; G04B 47/04; G04B 39/00

[52] U.S. Cl. ..... 368/285; 368/296

[58] Field of Search ..... 58/88 G, 88 WC, 89; 368/285, 296

[56] References Cited

U.S. PATENT DOCUMENTS 2,815,640 12/1957 Kirshner ..... 58/88 G

*Primary Examiner*—David Smith, Jr.
*Assistant Examiner*—John B. Conklin
*Attorney, Agent, or Firm*—Herzig & Walsh, Inc.

[57] ABSTRACT

An ornamental appliance or device which is removably attachable to another item, such as, more especially, a wrist watch to enhance its appearance. In the preferred form of the invention, it is a member in the form of a bezel which may have jewels or gem stones set in it, which can be detachably secured to a wrist watch case or a holder for the wrist watch case. The article may be circular or may have other shapes. Particular attachment means are provided in the form of hinged clamping members secured to the primary item, such as the extensions on a wrist watch to which the band is secured.

1 Claim, 5 Drawing Figures

DECORATIVE OR ORNAMENTAL APPLIANCE FOR USE WITH ARTICLES SUCH AS WRIST WATCHES

BACKGROUND OF THE INVENTION

1. Field of the Invention

The field of the invention is that of ornamental attachments or appliances that may be used for another article as a primary item, such as more particularly a wrist watch.

2. Description of the Prior Art

With respect to the prior art, the following U.S. patents are known: U.S. Pat. Nos. 1,553,571; 1,591,512; 2,228,755; 2,605,604; and 2,948,106.

It is known in the prior art to apply decoration or adornment to a watch case and no doubt to various jewelry items, such as jewelry items which contain a setting of gem stones or the like. There is a need however which is unfilled for the capability of easily and readily attaching a removable decorative or adorning member to another item, so that the decoration or adornment can be easily changed as desired. This capability is particularly desirable in connection with wrist watches. U.S. Pat. No. 2,605,604 shows a removable ornamental frame member, but this disclosure does not otherwise meet the need as identified. An improvement which is considered to meet the need is described in detail in the disclosure hereinafter.

SUMMARY OF THE INVENTION

In the preferred exemplary form of the invention, as described in detail herein, it takes the form of a removable bezel, which may have gem stones set in it constructed for removable securement to a wrist watch or to a holder containing a wrist watch. In the exemplary form, the removable bezel is circular with attachment or securement means for securing it to the wrist watch.

Normally, a wrist watch or wrist case has parts formed on it to which the wrist band is attached. In the exemplary form disclosed herein, the wrist watch case or holder has integral extending members to which the band may be attached. The removable bezel has hinged clamping members on the underside which clamp to the members or extensions on the wrist watch case or holder to which the band is attached. The clamping members are readily attachable and releasible so that the bezel can easily be removed for substitution of another one as desired.

In the light of the foregoing, the primary object is to make available a removable decorative or adornment member, which is removably attachable to another item such as more specially a wrist watch to provide the capability of readily changing or varying the adornment that appears on or in association with the primary item.

Another object is to provide an adornment device as in the foregoing, which is in the form of a circular bezel adapted for attachment to a wrist watch or a wrist watch casing with clamping members for easily clamping the adornment member to and removing from the wrist watch.

Further objects and additional advantages will become apparent from the following detailed description and annexed drawings.

Figure 1:
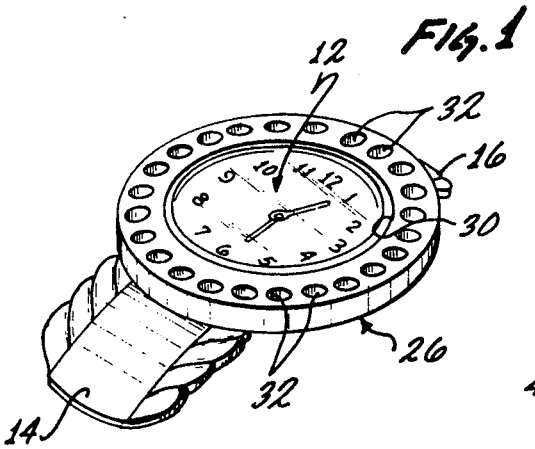
FIG. 1 is a pictorial view of a preferred form of the invention attached to a wrist watch.
Figure 2:
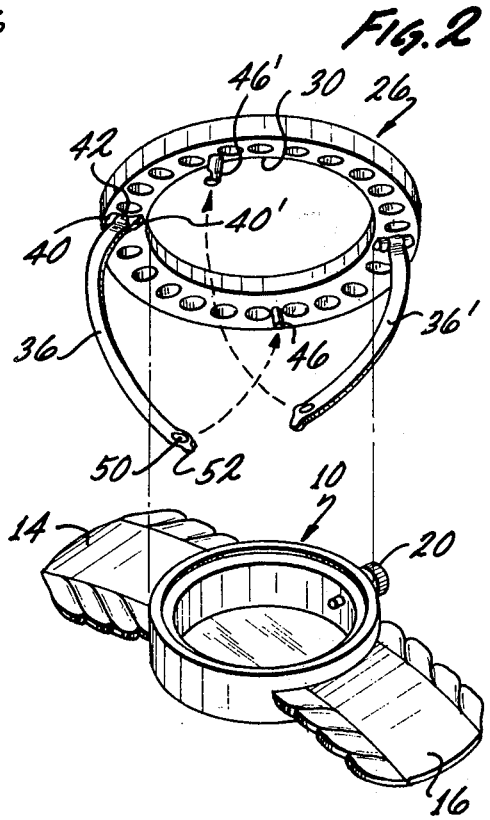
FIG. 2 is an exploded view showing the form of the invention of FIG. 1 and the manner of attaching it to a wrist watch or wrist watch casing.

DESCRIPTION OF THE PREFERRED EMBODIMENT AND BEST MODE OF PRACTICE OF THE INVENTION

A preferred exemplary embodiment of the invention is illustrated in FIGS. 1–5. In this form of the invention, the ornamental or adornment member is constructed to be adapted to be removably attached to a wrist watch or a wrist watch casing. It is possible however that such an ornamental member could be removably attached to certain jewelry items such as the settings for jewels or gem stones. In the figures numeral 10 designates a circular holder or casing for a wrist watch, the wrist watch itself being identified at 12 in FIG. 1. Integral with the member 10 are curved extending members 14 and 16 each of which has ornamentation along its edges. These members are of a type to which a typical watch band may be attached. A wrist watch can be fitted into the circular member 10 of FIG. 2, a winding stem being shown at 20. The article of the invention, that is the ornamental member or adorning member is identified by the numeral 26. In the form of the invention shown, it is shown as a circular member, that is a ring shaped member of a size to fit snugly around the holder 10 or it could fit snugly around the wrist watch itself. The wrist watch and the member 26 could have shapes other than circular.

The member 26 has a center opening 30 of a size to fit snugly around the upper part of the casing 10 or it would fit snugly around the case of a wrist watch itself. As shown the member 26 has circularly arranged settings to receive jewels or gem stones as identified by the numeral 32. The outer surface of the ring 26, might of course have any type of decoration or adornment.

The member 26 is removably attachable to the holder 10 or to the wrist watch itself. It fits over the member 10 as described and then it can be clamped to the integral extensions 14 and 16.

Hinged to the underside of the member 26 are clamp members 36 and 36'. The clamp members are curved, that is they are arcuate, having a radius corresponding to that of the member 26, so that they can swing towards the underside of the member 26 for clamping. The clamp members 36 and 36' clamp under the extensions 14 and 16 or that is, they clamp over these members when looking at the assembly from the back side as in FIG. 3.

Figure 5:
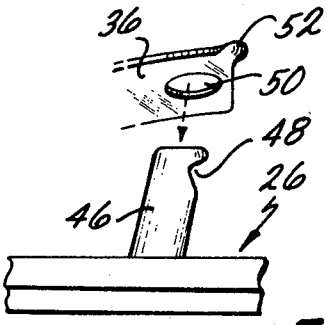
FIG. 5 is a detail view of an end part of a clamping member and a securement post on the underside of the adornment member.
Figure 4:
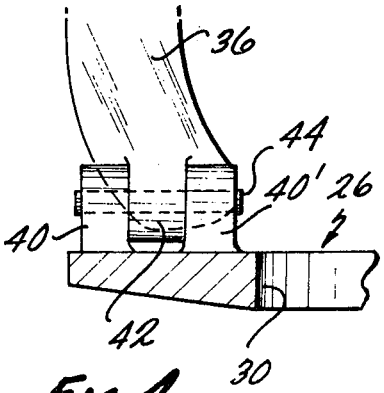
FIG. 4 is a detail view of the hinge whereby the clamping member is hinged to the underside of the adornment member.

FIG. 4 illustrates in detail one of the hinges whereby the clamping members 36 and 36' are hinged to the member 26. Extending from the underside of the member 26 as shown are projections 40 and 40' which form a yoke. At the hinged end of the member 36, it has an extending part 42 which fits into the yoke formed by the members 40 and 40' and it is hingedly attached thereto by way of the hinge pin 44. The two hinges are alike. The end of the clamp 36 cooperates with a securing post 46 extending downwardly from the underside of the member 26 and the end of the clamp member 36' cooperates with a securing post 46' extending downwardly from the underside of the member 26. As shown in FIG. 5, the end of the clamping member 36 has an aperture 50 in it shaped to fit over the post 46 as shown which has a detent notch 48 in it so that the clamping member 36 may be releasibly latched to the post 46. The end part of the clamping member 36 has an extending tab 52 which can accomodate a person putting his finger nail underneath the tab to lift the end of the clamping member 36 to release the latching engagement with the post 46.

The latching connection at the end of the member 36' is like that at the end of the clamping member 36.

Figure 3:
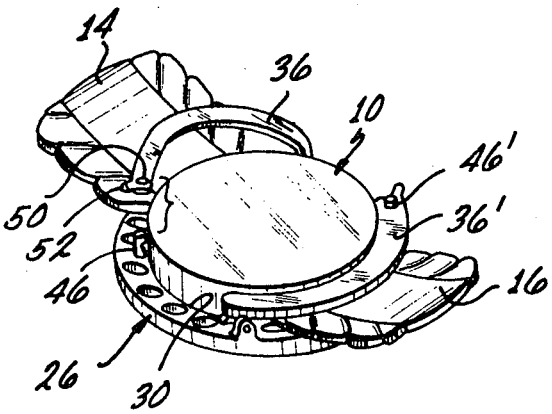
FIG. 3 is a pictorial view showing the back side of a wrist watch and the removable adornment member.

From the foregoing, those skilled in the art will readily understand the nature of the construction and the manner of its utilization. As previously described, a watch can be fitted into the circular member 10. The ornamental member 26 which is in the form of a removable bezel can then be fitted down over the circular member 20 or directly over a circular watch case. The hinged clamping members 36 and 36' which conform in contour to the circular member 26 can then be positioned underneath the extensions 14 and 16 and secured, that is clamped to the posts 46 and 46' as described and as illustrated in FIG. 3. In this manner, the purposes of the invention are achieved. Members 26 can be provided having various different patterns of decoration or ornamentation and they can be used as desired. That is one of them can easily be removed from the watch and another substituted and quickly and readily secured to the watch. Thus, the pleasing appearances produced by the article, that is the watch can be greatly varied as desired to suit the circumstances or the wishes of the wearer. The member 26 can be thought of as a removable bezel, the particular means of attachment or securement being so constructed as to not be visible when the removable bezel is secured and yet being easily releasible for removal without any tools, but rather only by use of the user's finger nail. Thus, in this way all of the objectives as set forth in the foregoing are realized.

While the preferred form of the invention is shown as utilized with a wrist watch, it is possible that the same type of removable ornamental or adornment member might be used with other items, that is jewelry items wherein a setting is provided for example with a jewel or gem stone in it, the setting providing a unit to which the removable decorative or ornamental part is attached.

The foregoing disclosure is representative of a preferred form of the invention and is to be interpreted in an illustrative, rather than a limiting sense, the invention to be accorded the full scope of the claims appended hereto.

What is claimed is:

1. In combination: an item of jewelry and a separable decorative member thereon;

said item of jewelry comprising a watch having an arcuate outline and band attaching parts extending from opposite sides thereof;

said member being of ring-like configuration having an opening of the same size and shape as said arcuate outline of said watch and surrounding the same overlying said attaching parts, said member having visible ornamentation thereon;

clamping members underlying and hinged to said member, extending under said attaching parts in respectively opposite directions, the unhinged ends of said clamping members being releasably secured to said member; and said clamping members being of arcuate shape to be concealed by said ring-like member.

* * * * *